US007325351B1

(12) United States Patent
Leung

(10) Patent No.: US 7,325,351 B1
(45) Date of Patent: Feb. 5, 2008

(54) ROTATING HAND GRIP TRIGGER ASSEMBLY FOR SMALL ARMS

(75) Inventor: Fee Chan Leung, Hazlet, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 11/288,064

(22) Filed: Nov. 23, 2005

(51) Int. Cl.
*F41A 11/04* (2006.01)
*F41A 21/00* (2006.01)

(52) U.S. Cl. ..... 42/75.03; 42/75.04; 42/71.01; 42/73

(58) Field of Classification Search ..... 42/71.01, 42/73, 75.03, 75.04
See application file for complete search history.

(56) References Cited

U.S. PATENT DOCUMENTS 146,651 A * 1/1874 Byrkit ..... 42/73
243,553 A * 6/1881 Hape et al. ..... 42/73
669,871 A * 3/1901 Zoeller ..... 42/73
855,229 A * 5/1907 Clarisey ..... 42/73
3,369,316 A * 2/1968 Miller ..... 42/72
6,543,173 B1 * 4/2003 Golan ..... 42/75.04
6,598,329 B1 * 7/2003 Alexander ..... 42/71.01
6,901,691 B1 * 6/2005 Little ..... 42/118

* cited by examiner

*Primary Examiner*—Bret Hayes
(74) *Attorney, Agent, or Firm*—Michael Zelenka; George B. Tereschuk

(57) ABSTRACT

A firearm includes a barrel that has a central axis, a receiver fixedly supporting the barrel, and a gunstock that is connected to the receiver and that has a longitudinal axis. The gunstock and the receiver are each configured to provide for angular movement of the gunstock relative to the receiver and, in turn, the barrel whereby the central axis of the barrel varies in a generally radial direction extending from the longitudinal axis of the gunstock. In this way, the firearm may be discharged by a warfighter, standing adjacent to a corner, around the corner.

7 Claims, 2 Drawing Sheets

ROTATING HAND GRIP TRIGGER ASSEMBLY FOR SMALL ARMS

GOVERNMENT INTEREST

The invention described herein may be manufactured, used, imported, sold, and licensed by or for the Government of the United States of America without the payment of any royalty thereon or there for.

BACKGROUND OF THE INVENTION

1. Field of the Invention

The present invention relates generally to firearms and, more particularly, to guns for use in urban combat.

2. Related Art

During urban warfare, many times a warfighter may be faced with a situation in which, in taking a position for cover, the warfighter may be located immediately adjacent a building corner, a doorway corner or some other obstacle that blocks line of sight to a target. While imaging devices, such as scopes and the like, are flexible enough to be used to generate a suitable image of the target regardless of line of sight, a conventional firearm lacks an ability to be effectively fired at the target from behind the corner or obstacle without exposing a substantial portion of the warfighter's body to return fire.

One solution employed by warfighters is to, while standing adjacent a corner and holding a firearm in a ready to fire manner, rotate a conventional firearm such that a transverse axis of a gunstock of the gun is disposed generally parallel to the ground and then to extend the firearm around a corner while using a thumb to actuate the trigger. While this solution reduces the area of the warfighter's body to return fire, it has several disadvantages including that of reduced control over actuation of the trigger and over the recoil of the firearm.

SUMMARY OF THE INVENTION

In accordance with an embodiment of the present invention, a firearm comprises a barrel that has a central axis, a receiver fixedly supporting the barrel, and a gunstock that is connected to the receiver and that has a longitudinal axis. The gunstock and the receiver are each configured to provide for angular movement of the gunstock relative to the receiver and, in turn, the barrel whereby the central axis of the barrel varies in a generally radial direction extending from the longitudinal axis of the gunstock. In this way, the firearm may be discharged by a warfighter, standing adjacent to a corner, around the corner.

BRIEF DESCRIPTION OF THE DRAWINGS

The following detailed description is made with reference to the accompanying drawings, in which:

FIG. 1(*b*) is a schematic diagram showing the firearm of FIG. 1(*a*) with the gunstock rotated with respect to a longitudinal axis of the barrel;

FIG. 2(*b*) is a side view of the gunstock of FIG. 1(*a*);

FIG. 3(*b*) is a schematic diagram, in cross section, showing actuation of the trigger assembly of FIG. 3(*a*) with the trigger depressed adjacent the gunstock; and FIG. 3(*c*) is a schematic diagram, showing the receiver of FIG. 1(*a*).

DETAILED DESCRIPTION OF THE PREFERRED EMBODIMENT

One embodiment of the present invention concerns a firearm which is configured to fire at a target from behind a corner or an obstacle without exposing a warfighter's body to return fire. More particularly, the firearm is configured such that it may be discharged along an axis at a relatively large angle to its conventional discharge axis, without requiring the warfighter who discharges the firearm, to be contorted while manipulating the trigger. In one particular embodiment, the trigger assembly is pivotal relative to the receiver thereof.

Figure 1A:
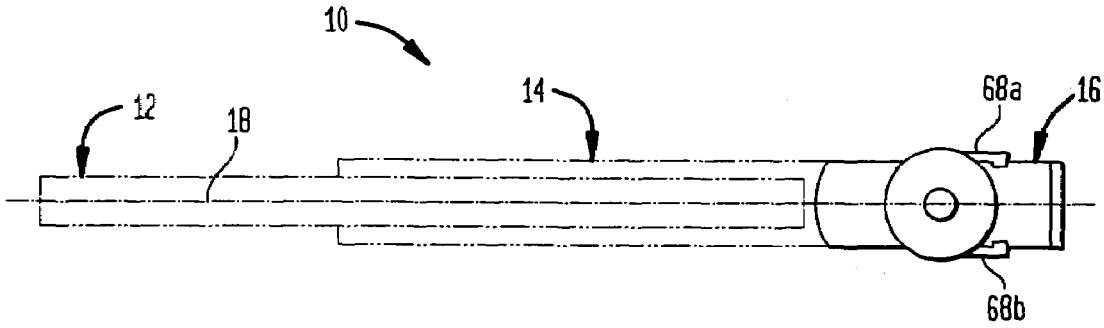
FIG. 1(*a*) is a schematic diagram showing a top view of a firearm having a gunstock, a receiver and a barrel in accordance with an embodiment of the present invention.
Figure 1B:
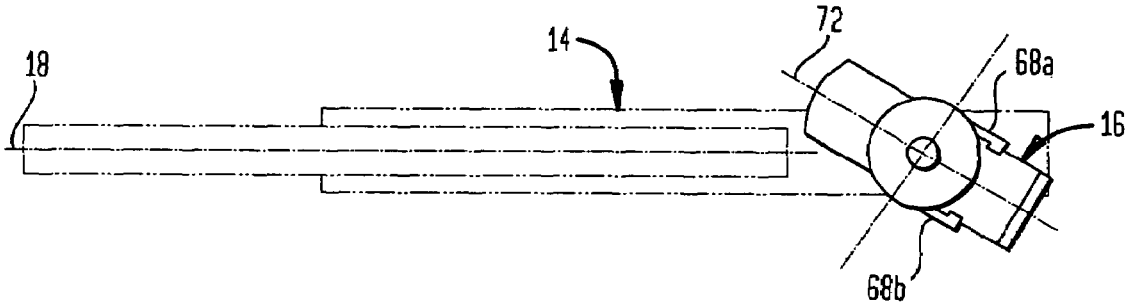

Referring now to FIGS. 1(*a*) and 1(*b*), a firearm, in accordance with one embodiment of the present invention, is illustrated generally at 10. In this embodiment, the firearm 10 comprises a barrel 12, a receiver 14 and a gunstock 16. The barrel 12 may be machined in a known manner from a suitably strong and durable material such as steel. The barrel 12 may be integrally connected to the receiver 14 as shown and comprises a central axis 18.

Figure 3B:
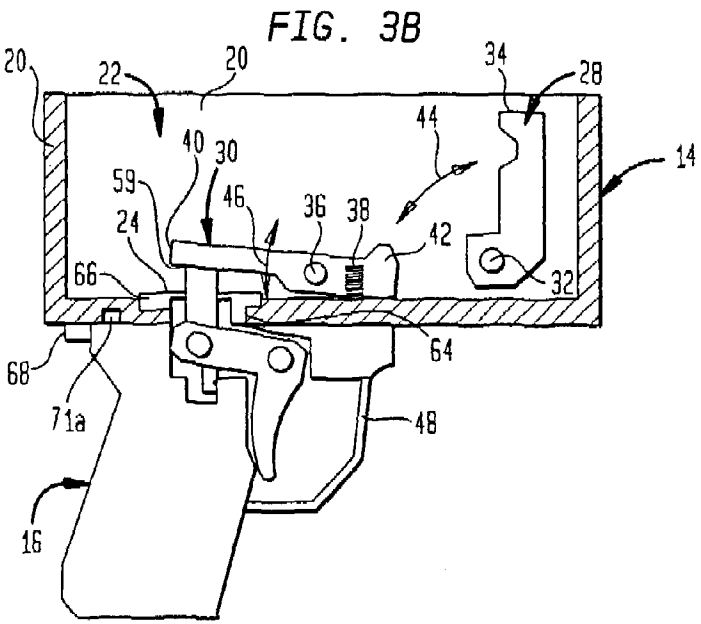
FIG. 3(*a*) is a schematic diagram, in cross section, showing the receiver and the gunstock, which comprises a trigger assembly and a trigger, of FIG. 1(*a*)
Figure 3A:
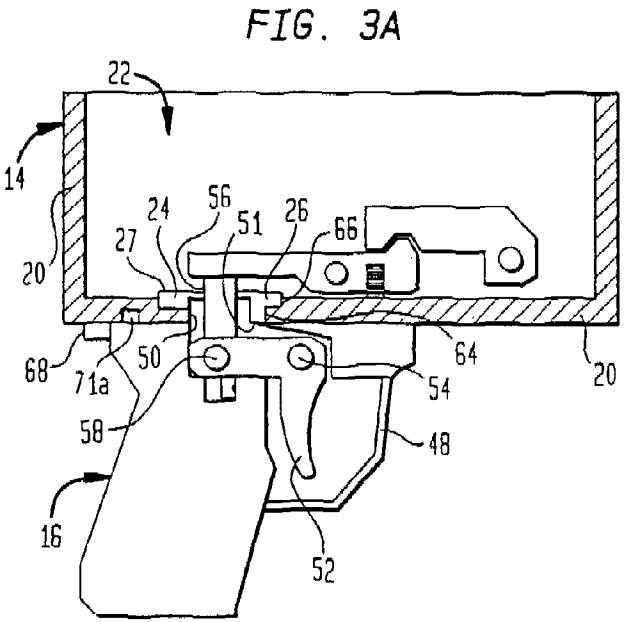
Figure 3C:
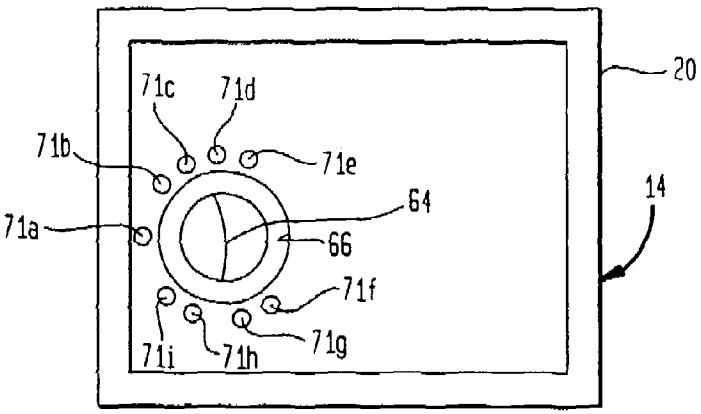

The receiver 14, which is best seen in FIGS. 3(*a*) and 3(*b*) may be composed of a suitably strong material such as steel and comprises walls 20 which define compartment 22 and an aperture 24. The aperture 24 comprises a shoulder portion 26 having a bearing surface 27.

Referring in particular to FIG. 3(*b*) for a moment, the receiver 14 may also comprise a hammer 28 and a sear 30. The hammer 28 is rotatably mounted to the receiver 14 via a pin 32 and has a grooved portion 34. The sear 30 is rotatably mounted to the receiver 14 via a pin 36 and is biased by a spring 38. The sear 30 may comprise an arm portion 40 and a catch portion 42 with the latter being configured to mate with the grooved portion 34 of the hammer 28. Arrows 44 and 46 make clear the rotational movement of the hammer 28 away from the sear 30 and rotation of the sear itself as evident from a comparison of FIG. 3(*a*) with FIG. 3(*b*).

The gunstock 16 may be composed of a similar material to that of the receiver 14 and comprises a trigger guard 48 and trigger assembly 50 located within a cavity 51. The trigger assembly 50 may comprise a trigger 52 which is rotatably mounted to the gunstock via a pin 54 and to a reciprocable member such as rod 56 via a pin 58. As can be seen in FIGS. 3(*a*) and 3(*b*), as the trigger 52 is pulled, the rod 56 pushes against a bearing surface 59 of the arm portion 40 of the sear 30, in turn, releasing the hammer 28.

Figure 2A:
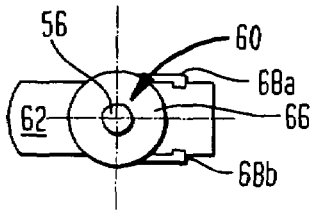
FIG. 2(*a*) is a top view of the gunstock of FIG. 1(*a*)
Figure 2B:
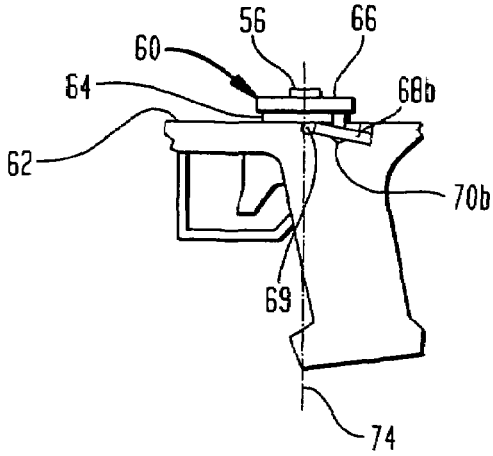

In accordance with the present embodiment, and as best seen in FIGS. 2(*a*) and 2(*b*), the gunstock 16 may comprise a member 60 that may be cylindrical in outer configuration and extends from a contact surface 62. The member 60 may comprise a body portion 64 and a head portion 66 that provides for a rotatable connection between the gunstock 16 and the receiver 14.

A pair of arms 68*a*, 68*b*, may be located on the gunstock 16 and may be engageable by a thumb of either a left handed or right handed warfighter (not shown), to provide for releasable movement of the gunstock 16 relative to the receiver 14. The arms 68*a*, 68*b* may each extend from opposing ends of a rotatable rod 69. Referring to FIGS. 2(*b*) 3(*a*) and 3(*c*), a reciprocable pin 70*b* may be moved by the arm 68*b* and may be reciprocated into and out of a plurality of bores 71*a*-71*i* through movement of either of the arms 68*a*, 68*b* and rotation of the receiver 14 relative to the gunstock 16, as described below. Another reciprocable pin (not shown) may be connected to the arm 68*a* and function similar to the reciprocable pin 70*b*.

Referring again to FIGS. 3(*a*) and 3(*b*), the receiver 14 may be assembled with the gunstock 16 such that the body portion 64 and the head portion 66 of the member 60 engage the aperture 24 and shoulder 26, respectively, of the receiver. In this way, the body portion 64 is rotatable within the aperture 24 while the head portion 66 is supported by, and slideably rotatable against, the shoulder 26.

In operation and as shown in FIGS. 1(*a*) and 1(*b*), after release of the arms 68*a*, 68*b*, the gunstock 16 may be rotated with respect to the receiver 14 and barrel 12 whereby an axis 72 of the gunstock, that is transverse to a longitudinal axis 74 (FIG. 2(*b*)) of the gunstock, may be disposed at an acute angle to the central axis 18 of the barrel 12.

While the present invention has been described in connection with what are presently considered to be the most practical and preferred embodiments, it is to be understood that the present invention is not limited to these herein disclosed embodiments. Rather, the present invention is intended to cover all of the various modifications and equivalent arrangements included within the spirit and scope of the appended claims.

What is claimed is:

1. A firearm comprising:

a barrel having a central axis;

a receiver fixedly supporting the barrel;

a gunstock connected to the receiver, the gunstock comprises a longitudinal axis;

wherein the gunstock and the receiver each being configured to provide for angular movement of the gunstock relative to the receiver and, in turn, the barrel whereby the central axis of the barrel varies in a generally radial direction extending from the longitudinal axis of the gunstock, whereby, the firearm may be discharged by a user, standing adjacent to a corner, around the corner;

the gunstock comprises a connector joint that is configured to rotatably engage with the receiver, wherein the connector joint comprises a cylindrical member extending from the gunstock that is dimensioned to mate with a correspondingly configured aperture located on the receiver;

wherein the cylindrical member comprises a body portion and a head portion, and wherein the aperture comprises a shoulder portion and a shoulder portion bearing surface whereagainst the head portion is supported and rotatable; and wherein the gunstock comprises a cavity, the cylindrical member comprises a bore communicating with the cavity and the receiver comprises a compartment communicating with the bore and further comprising a trigger assembly extending through the cavity, the bore and the compartment.

2. The firearm of claim 1, wherein the trigger assembly comprises:

a trigger pivotably mounted within a cavity of the gunstock that communicates with the bore of the cylindrical member;

a reciprocable member pivotably connected to the trigger and extending through the bore of the cylindrical member;

a sear slidingly engaging the reciprocable member and being pivotably mounted within a compartment of the receiver;

a sear spring located in the compartment of the receiver and configured to exert a bias force against the sear; and a hammer pivotably mounted in the compartment of the receiver and configured to releasably engage the sear.

3. The firearm of claim 2, wherein the reciprocable member comprises a rod which has a free end and the hammer comprises an arm having an arm bearing surface which is dimensioned and configured to engage the free end of the rod during the angular movement of the gunstock relative to the barrel.

4. The firearm of claim 3, wherein the sear comprises a groove portion and the hammer comprises a catch portion that is correspondingly configured to the groove portion to provide the releasable engagement between the sear and the hammer.

5. The firearm of claim 4, wherein the gunstock further comprises at least one arm configured to engage and lock the receiver with the gunstock at various angles.

6. The firearm of claim 5, wherein the at least one arm comprises a pair of arms and further comprising a pair of reciprocable pins movable by either of the arms.

7. The firearm of claim 6 wherein the receiver comprises a plurality of bores arranged in an arcuate pattern and dimensioned and configured for receipt of at least one of the reciprocable pins for locking the gunstock in releasable engagement with the receiver.

* * * * *